US007377857B2

(12) United States Patent
Nottage

(10) Patent No.: US 7,377,857 B2
(45) Date of Patent: May 27, 2008

(54) GAMES TABLE AND PLAYING SURFACE FOR A GAMES TABLE

(76) Inventor: Craig Winfield Nottage, 81a Marine Parade, Seacliff, 5049 South Australia (AU)

( * ) Notice: Subject to any disclaimer, the term of this patent is extended or adjusted under 35 U.S.C. 154(b) by 0 days.

(21) Appl. No.: 11/002,971

(22) Filed: Dec. 2, 2004

(65) Prior Publication Data

US 2005/0124427 A1 Jun. 9, 2005

(51) Int. Cl.
*A63D 15/00* (2006.01)
*A63F 9/24* (2006.01)

(52) U.S. Cl. ..... 473/29

(58) Field of Classification Search ..... 473/1, 473/4, 6, 8, 29, 31, 14, 22; 273/309, 108; 108/23, 157.16

See application file for complete search history.

(56) References Cited

U.S. PATENT DOCUMENTS 3,085,568 A * 4/1963 Whitesell ..... 601/55
3,743,288 A * 7/1973 Danklefsen ..... 473/2
3,848,046 A * 11/1974 Machet ..... 264/279
3,889,945 A 6/1975 Ellis
4,093,216 A 6/1978 Dunn
4,618,151 A * 10/1986 Fadner et al. ..... 273/148 A
5,791,758 A * 8/1998 Horgan et al. ..... 362/554
5,830,072 A * 11/1998 D'Aguiar ..... 473/33
5,948,520 A 9/1999 Hirsch
6,279,905 B1 * 8/2001 Malavazos et al. ..... 273/126 A
6,854,728 B2 * 2/2005 Oister et al. ..... 273/108.1
2005/0011603 A1 * 1/2005 Button et al. ..... 156/94

FOREIGN PATENT DOCUMENTS

GB 8913687.3 6/1989
GB 2232606 A * 12/1990
WO WO99/58024 11/1999

* cited by examiner

*Primary Examiner*—Mitra Aryanpour
(74) *Attorney, Agent, or Firm*—Klauber & Jackson

(57) ABSTRACT

A games table such as a billiards table (1) has an upper support pad (7) on each leg (3, 4) and a planar glass playing surface (9) supported on the support pads. Pockets (11) are formed around the periphery of the playing surface and cushions (13) are positioned around the periphery of the playing surface. The cushions are fastened to the playing surface. A transparent liquid or gel layer (42) is provided on the playing surface with a flexible transparent liquid impervious material (44) over the liquid gel to provide a rolling resistance and sound deadening on the surface of the table. A laminate (27) for use as a ball playing surface which provides rolling resistance is also provided.

18 Claims, 4 Drawing Sheets

GAMES TABLE AND PLAYING SURFACE FOR A GAMES TABLE

FIELD OF INVENTION

This invention relates to a games table and a playing surface for a games table and in particular to a games table upon which has a substantially planar upper surface upon which a ball is propelled and in which some rolling resistance for the ball is desired.

BACKGROUND OF THE INVENTION

Games tables of the type to which the present invention is directed include such types as billiard and snooker tables. Such tables have traditionally been made from a slate base and a covering of felt over the slate with the felt providing rolling resistance for a ball. Generally such games tables have heavy wooden frames to support the slate base and are extremely heavy. There is also little scope for a designer to devise innovative designs.

It is the object of this invention to provide a games table and a playing surface for a games table which is more innovative and modem in design and allows for flexibility for a designer. A further object is to provide an alternative playing surface material for an existing games table such as a billiards table.

BRIEF DESCRIPTION OF THE INVENTION

In one form therefore, although this may not be necessarily be the only or broadest form the invention is said to reside in a sports table having playing surface adapted for a rolling ball and providing some resistance to the rolling of the ball, the playing surface providing a solid planar base, a liquid or gel layer on the base and a flexible liquid-impervious material over the liquid or gel layer.

In an alternative form the invention is said to reside in a billiards table having a playing surface providing rolling resistance, the playing surface comprising a solid planar base, a liquid or gel layer on the planar base and a flexible liquid impervious material over the liquid or gel layer. The liquid maybe water and oil, a silicone fluid or the like.

The flexible film maybe a polyester film, a polyurethane film, a plasticised PVC film, a silicone rubber film or a PTFE(Teflon™) film.

There may be further included a second layer of a flexible liquid impervious material below the liquid or gel layer whereby a sandwich effect is formed with a flexible liquid impervious upper and lower material with the liquid or gel between them. In one embodiment the flexible film above and below the gel layer may form a separate envelope which can be removed from the glass playing surface.

The second layer of a flexible liquid impervious material below the liquid or gel layer may be a similar material to that of the upper flexible liquid impervious material or it may be a different material. The second layer may be a thicker and softer material which would have the advantage of:

Reducing the noise of the ball impacting the glass (or any other surface such as slate or wood, if fitted to a traditional table) from a height.

Preventing damage to the glass from a ball being dropped from a height or from the ball landing after someone has taken a 'jump shot'.

Preventing the ball slowly moving from its stationary position due to the table surface not being perfectly level.

The second layer may be formed from polyethylene, polypropylene, plasticised PVC, polyester, polyurethane, silicone, Teflon (PTFE) sheet or the like. In an alternative embodiment the lower flexible film may be the same as the upper sheet and a further shock and sound absorbing layer placed underneath it. Such a further shock and sound absorbing layer may be polyethylene, polypropylene, plasticised PVC, polyester, polyurethane, silicone, Teflon (PTFE) sheet or the like. Alternatively the shock and sound absorbing layer may be a more rigid material such as polycarbonate or acrylic.

The solid planar base maybe selected from material from the group comprising slate, wood or glass.

In a preferred embodiment the playing surface is glass and the playing surface and the flexible film and the liquid or gel are all transparent to provide a transparent upper playing surface for the games or billiards table.

In an alternative form the invention is said to reside in a laminate for a playing surface of a games table of the type where rolling resistance for a ball is desirable, the laminate comprising an envelope of two flexible liquid impervious films and a liquid or gel within the envelope.

The flexible film maybe selected from polyester film, polyurethane film, PVC film, a silicone rubber film or a PTFE(Teflon™) film.

The second or lower layer of a flexible liquid impervious material below the liquid or gel layer may be a similar material to that of the upper flexible liquid impervious material or it may be a different material. The second layer may be formed from polyethylene, polypropylene, plasticised PVC, polyester, polyurethane, silicone, Teflon sheet or the like.

The liquid or gel may be selected from water, silicone fluid or mineral oil.

In a preferred embodiment the liquid is silicone fluid having a viscosity in the range of 50 to 10000 centistokes and preferably a viscosity of about 500 centistokes.

The laminate for the playing surface of a games table may comprise a peripheral frame to hold the edges of the laminate. This frame may be mechanically fastened, heat sealed, adhered or taped to the edge of the laminate.

The edge of the laminate or the frame around the edge of the laminate may include resilient means such as a resilient band to attach it to the edge of the table top such as a glass table top so that the laminate can be held under tension. Holding the laminate under tension will assist with absorbing differential thermal expansion and contraction between the table top and the laminate. For instance the resilient band may be clamped under the cushion assembly.

The laminate may also include cut outs or apertures to enable bolts or other fasteners for the cushion assembly to extend to the table top.

One of the flexible films or the glass surface of the games table may have a printing, an illustration or advertising thereon or allow a separate sheet of advertising material to be placed underneath it. The separate sheet could have advertising, brand or logos provided on it.

In an alternative form the invention is said to reside in a billiards table having at least four legs each leg having an upper support pad, a planar glass playing surface supported on the support pads, a plurality of pockets formed around the periphery of the playing surface, cushions around the periphery of the playing surface, the cushions being fastened to the playing surface, a transparent liquid or gel layer on the playing surface and flexible transparent liquid impervious material over the gel.

There maybe further included a flexible film below the transparent liquid or gel layer on the playing surface.

In one embodiment the flexible film above and below the gel layer may form a separate envelope which can be removed from the glass playing surface. The flexible transparent liquid impervious material may be selected from polyester film, polyurethane film, plasticised PVC film or silicone film.

There may be further provided a hard coating on the upper flexible film so that scuffing of the surface does not occur with balls being propelled across the surface. Such a hard coating maybe provided a silicone polish or the like.

The billiard table may have a glass thickness of from 6 to 35 millimetres. The upper flexible film may have a thickness from 0.1 to 2 millimetres, the lower film may have a thickness of from 0.1 to 3 mm and the liquid or gel layer may have thickness of 0.25 to 3 millimetre. The liquid may be a silicone fluid with a viscosity of 500 centistokes.

BRIEF DESCRIPTION OF THE DRAWINGS

This then generally describes the invention but to assist with understanding reference will now be made to accompanying drawings which are a preferred embodiment of the invention.

In the drawings.

DESCRIPTION OF PREFERRED EMBODIMENTS

Figure 1:
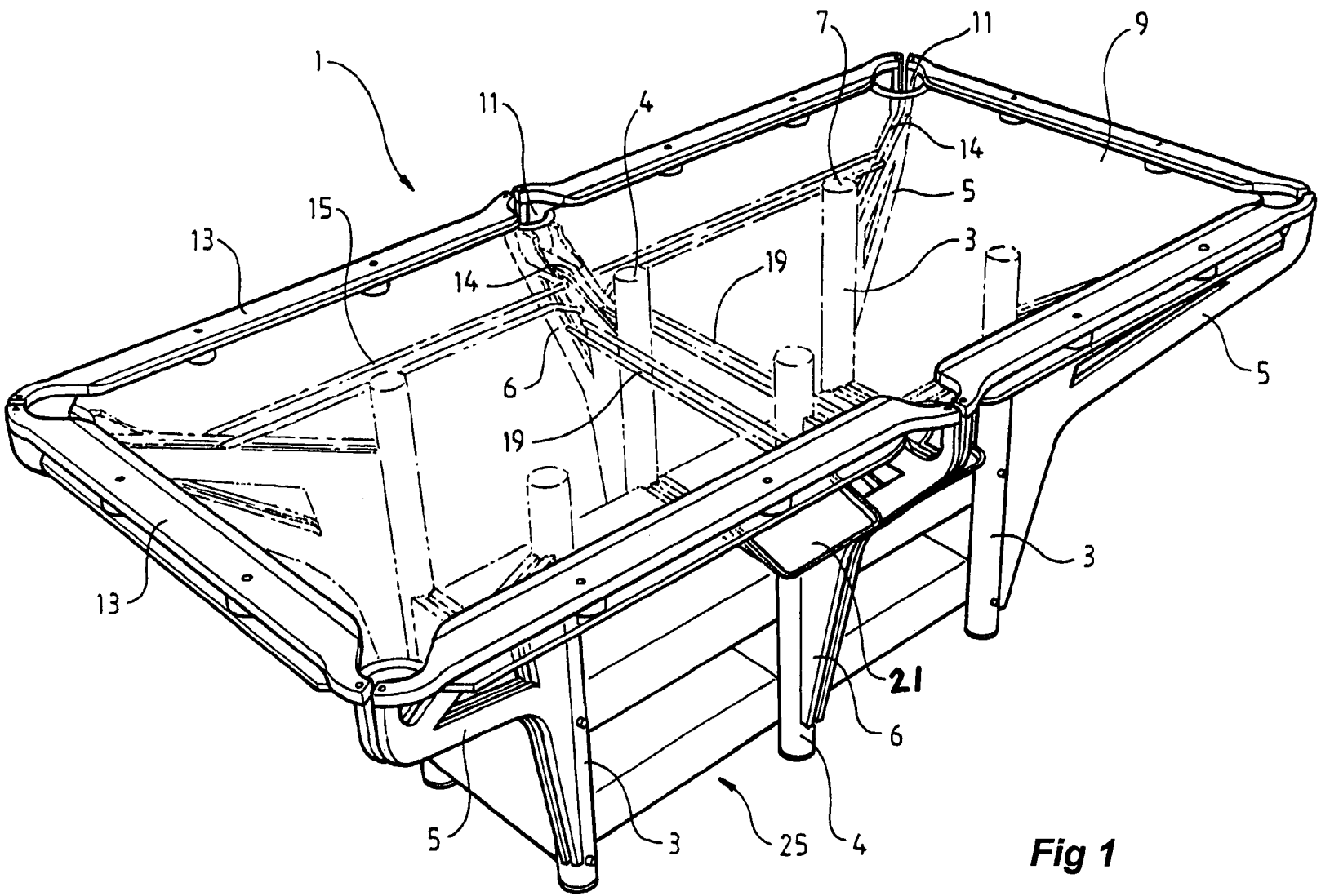
FIG. 1 shows a perspective view of a billiard table according to one embodiment of the invention.
Figure 2:
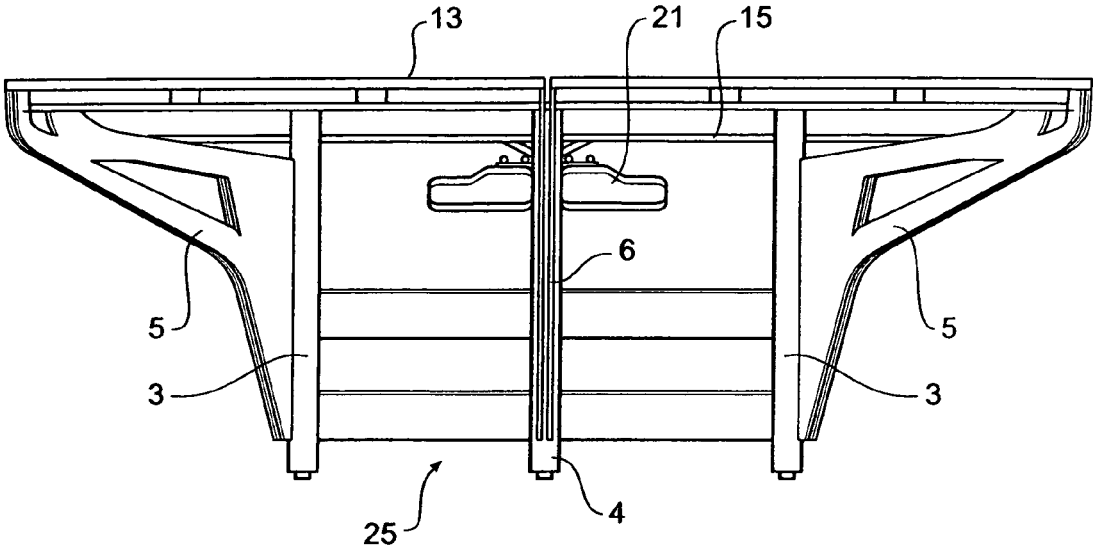
FIG. 2 shows a side view of the billiard table shown in FIG. 1.
Figure 3:
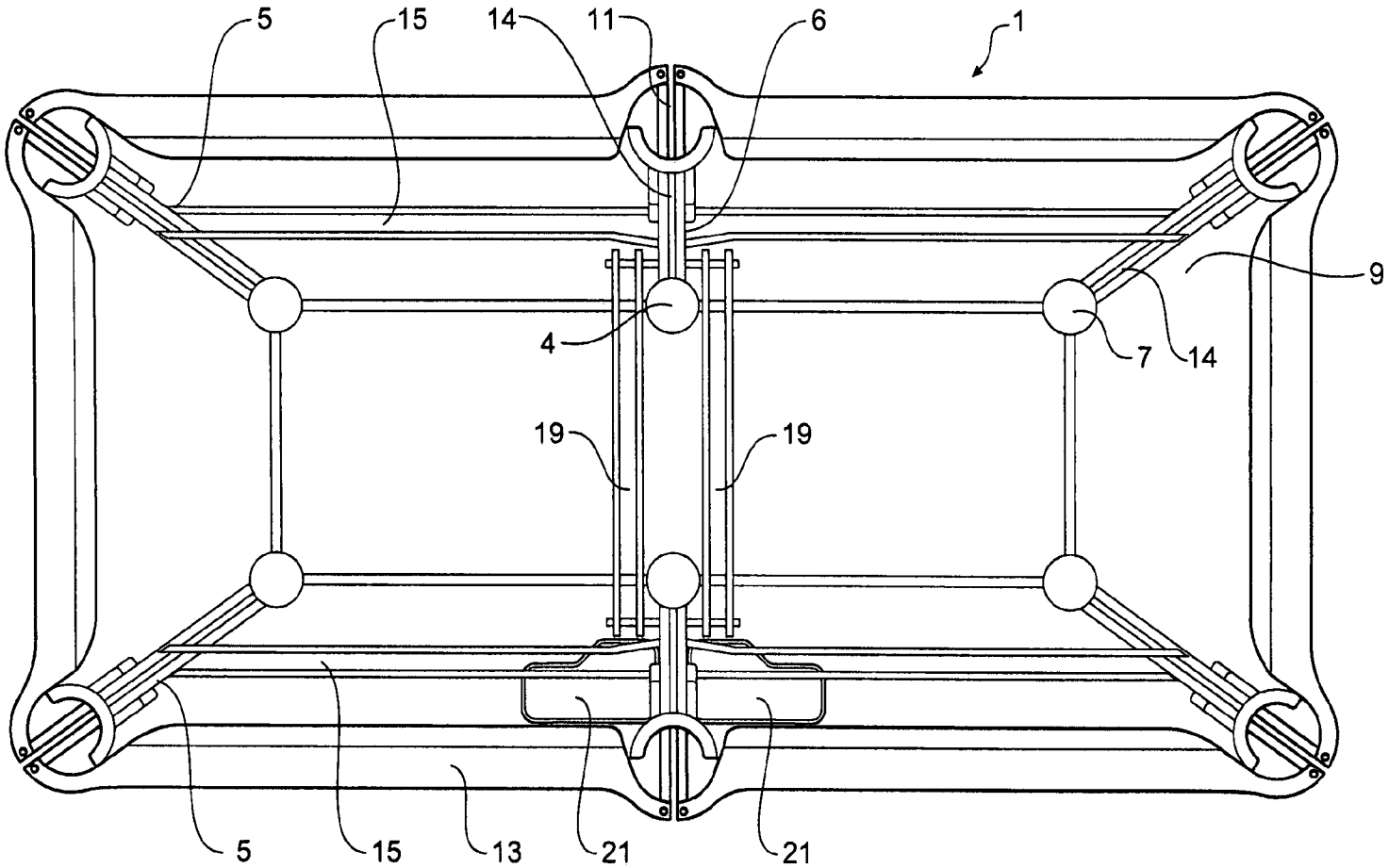
FIG. 3 shows a plan view of the billiard table shown in FIG. 1.

Now looking at the drawings and in particular an embodiment shown in FIGS. 1 to 3, it will be seen that the billiards table 1 comprises a four corner legs 3 with each leg having a corner wing 5 which extends to the comers of the table and two side legs 4 with side wings 6 which extend to the centre of the sides. A support pad 7 is provided on the top of each of the legs 3 and 4 and the glass playing surface 9 is supported on the support pads 7. Suitable levelling equipment (not shown) may be provided in the base of each leg to provide a horizontal playing surface for the billiard table. The construction of the playing surface 9 will be discussed in detail with particular reference to FIG. 5.

Figure 4:
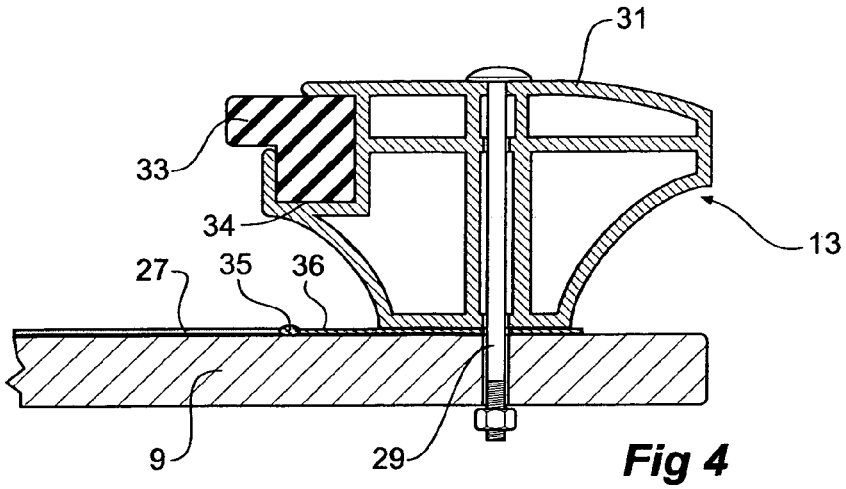
FIG. 4 shows one embodiment of side cushion according to the present invention.

At each corner of the playing surface 9 and in the middle of the sides there are pockets 11. Around the periphery of the table cushion assemblies 13 are provided in the same manner as an existing type of billiards table. The cushion assemblies may comprise an aluminium extrusion and be fastened to the glass table top 9 as shown in FIG. 4. The cushion assemblies could alternatively be injection moulded, plastics extrusions or formed by other methods.

A net to collect the balls may be provided at each pocket in a conventional manner but according to this particular embodiment of the invention a ball return system is provided.

The ball return system comprises a track 14 along the top of each wing 5 and 6 which directs a ball which enters a pocket 11 towards the legs of the table 3 and 4. The ball may alternatively travel through a groove in the wing. Where each wing 5 and 6 is formed from two adjacent plates the ball may travel between the two halves of the wing. Before the ball reaches the leg it is caught and travels along in a ball track 15 which extends along each side of the table under the table top 9 but visible through the glass top 9 from a corner wing 5 to the side wing 6 until the central side wing 6 is reached at which position the ball falls onto a cross tracks 19 and travel across the cross tracks at the end of which the ball falls into a receiving tray 21. Balls which fall through the pockets which are on the same side as the retrieving tray 21 fall directly from corner wing 5 to the side wing 6 along the longitudinal tracks 15 into the receiving tray.

In a storage area generally shown by the arrow 25 cues, triangles and a folding cover for the billiard table, when not in use, may be stored.

It will be seen that by this invention there is provided a billiard table of innovative and modern design with a transparent top.

For commercial applications advertising illustrations or the like may be provided on the transparent top or on the flexible film forming the playing surface envelope as will be discussed with respect to FIG. 5.

FIG. 4 shows one embodiment of cushion assembly 13. The glass playing surface 9 has the envelope or laminate 27 providing the rolling resistance on it. The envelope or laminate 27 extends under the aluminium extrusion 31 forming the cushion assembly 13 which is mounted onto the glass 9 by means of a bolt 29 which passes through the aluminium extrusion 31 forming the cushion assembly 13 and through the glass 9. The cushion 33 is received in a recess 34 in the cushion extrusion 31.

The envelope or laminate 27 has a peripheral frame 35 and a resilient band 36 extends from the frame 35 to be received under the cushion extrusion and to be clamped there. The resilient band 36 provides resilient tension to the envelope or laminate 27 which will assist with absorbing differential thermal expansion and contraction between the table top 9 and the laminate 27.

Figure 5:
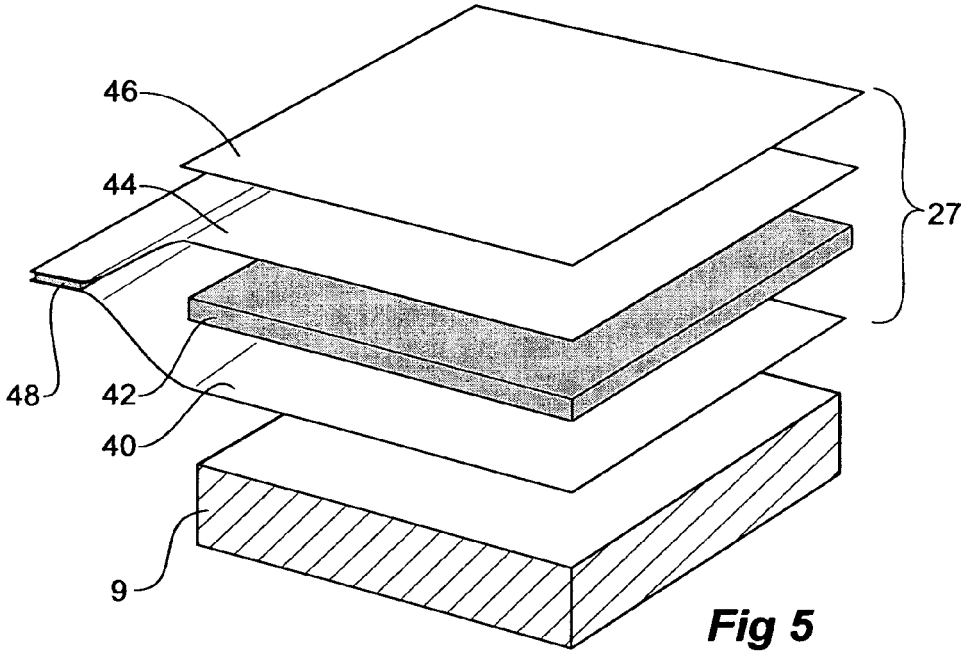
FIG. 5 shows a detailed view of the laminate structure for the surface of a ball playing table.

FIG. 5 shows the detail of the construction of one embodiment of the laminate which forms the playing surface. The glass layer 9 has an envelope 27 on it which comprises a first flexible impervious film 40, on that is a gel layer 42 and over that is another flexible impervious film 44. A hard layer 46 maybe provided onto the upper flexible film 44. The hard layer 46 can be provided by a transparent film vacuum deposited onto the film 44 or by a hard polish provided on the upper surface of the film 44.

The envelope 27 around the edge is sealed by heat sealing, double sided tape or adhesive 48 or other means and may be clamped under the cushion to provide a smooth and tight upper surface. The use of a double sided tape with some thickness will provide a thickness for the gel or liquid layer. As discussed earlier the edge of the laminate 27 may alternatively include a frame and a resilient band or hooks to hook around the edge of the table.

In one particular embodiment the flexible films 40 and 44 comprise a 250 micron type 515 Dupont Melinex™ film, above and below the liquid silicon. The silicone layer 42 is Dow Corning '200' silicone fluid, a water clear silicone with a viscosity rating of 500 centistokes.

A thinner film may not hold its flatness against the liquid silicone as well as a thicker one, so has an uneven appearance after balls have been rolling on it. Anything too thick will not slow the balls down enough as it doesn't 'take the shape' of the contact patch of the ball to allow the fluid to do its job. A range of viscosities between 200-1000 cps is preferred. The thinner/runnier silicon works in slowing the ball down but the ball tends to roll slowly after it has initially come to a stop. Thicker grade silicon does not slow the ball down from speed quite as well as thinner silicon, and tends to not recover the 'dents' made by the balls as quickly.

Figure 5A:
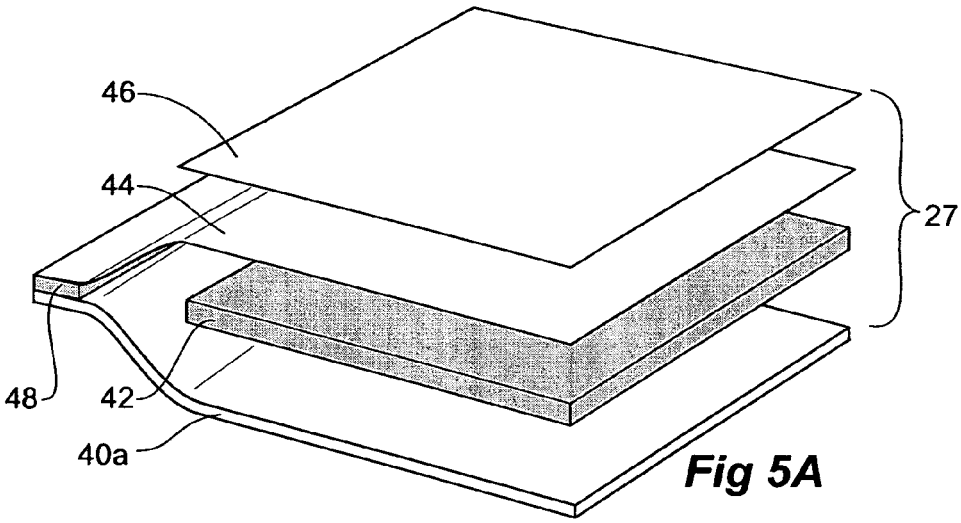
FIG. 5A shows a detailed view of an alternative structure of the laminate structure for the surface of a ball playing table.

FIG. 5A shows a detailed view of an alternative structure of the laminate structure for the surface of a ball playing table. An envelope 27 comprises a first lower flexible impervious film 40*a,* on that is a gel layer 42 and over that is an upper flexible impervious film 44. A hard layer 46 maybe provided onto the upper flexible film 44. The hard layer 46 can be provided by a transparent film vacuum deposited onto the film 44 or by a hard polish provided on the upper surface of the film 44. The lower flexible impervious film 40*a* is formed from a thicker and softer material than the upper flexible impervious film 44. This will assist with providing sound deadening and protection for a table surface from balls being dropped onto it.

The envelope 27 around the edge is sealed by heat sealing or adhesive 48 or other means and may be clamped under the cushion to provide a smooth and tight upper surface.

In one particular embodiment the upper flexible film 44 comprise a 250 micron type 515 Dupont Melinex™ film. The lower flexible film comprises a PVC with a thickness of 1 mm. The silicone layer 42 is Dow Corning '200' silicone fluid, a water clear silicone with a viscosity rating of 500 centistokes.

Figure 6:
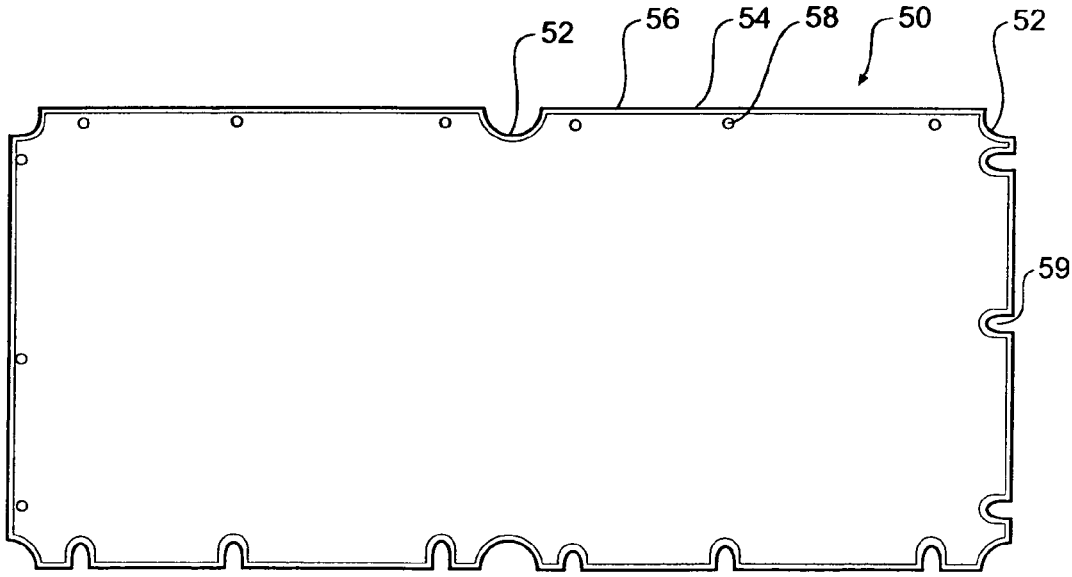
FIG. 6 shows a plan view of a laminate of the present invention suitable for use with a games table.

FIG. 6 shows a plan view of a laminate of the present invention suitable for use as a playing surface with a games table. The laminate 50 suitable for a billiards table has pocket cut outs 52 at the corners and the middle of the sides. Apertures 58 as shown on the upper and left hand side are provided around the periphery of the laminate 50 to enable the bolts which hold the cushion assembly to pass through. In an alternative, as shown on the lower and right hand sides, a cut out 59 may be provided to enable the bolts which hold the cushion assembly to pass through. In this embodiment the laminate envelope is formed from two sheets of Mylar™ polyester sheet joined together at the edges 54 by means of a double sided adhesive tape 56. Where the type of material of the film above and below the liquid or gel layer allows, the edges of the films may be heat sealed together to provide the envelope. The laminate may be of the type discussed in relation to FIGS. 5 or 5A.

A gas strut lift system (not shown) may be provided in each leg of the table according to the present invention to allow raising or lowing of the table between a billiard table height and a standard table height. A suitable locking mechanism (not shown) may be provided to remove the load from the struts when it is being used as a billiard table.

The frame to support the table comprising the legs and wings maybe provided in a form which can be assembled so that the playing table according to the present invention can be packed flat for transport.

It will be seen that by this invention there is provided a laminate surface for a games table and a games table including the laminate surface and in particular a billiards table which is innovative and modern in design but which provides rolling resistance substantially similar to conventional tables by the use of the laminate structure on the playing surface. The laminate structure provides rolling resistance and noise reduction.

The claims defining the invention are as follows:

1. A billiard table comprising a plurality of legs each of said legs having an upper support pad, a planar glass playing surface supported on the upper support pads of the plurality of legs, a plurality of pockets formed around the periphery of the planar glass playing surface, cushions located around the periphery of the planar glass playing surface, the cushions being securely fastened to the planar glass playing surface, a liquid or gel layer positioned on the planar glass playing surface and a flexible transparent liquid impervious film applied over the liquid or gel layer enclosing the liquid or gel layer between the planar glass playing surface and the flexible transparent liquid impervious film wherein the liquid or gel layer provides resistance to the rolling of a billiard ball across the flexible transparent liquid impervious film.

2. A billiard table as claimed in claim 1 further including a lower flexible film below the transparent liquid or gel layer on the playing surface.

3. A billiard table as claimed in claim 2 wherein the flexible film above and below the liquid or gel layer form a separate envelope which can be removed from the glass playing surface.

4. A billiard table as in claim 1 wherein the flexible transparent liquid impervious film is selected from the group comprising polyester film, polyurethane film, plasticised PVC film or silicone film.

5. A billiard table as in claim 1 wherein the liquid is a silicone fluid having a viscosity in the range of 50 to 10000 centistokes.

6. A billiard table as in any one of claims 1 to 5 wherein the glass, the flexible transparent liquid impervious film and the liquid or gel layer are all transparent.

7. A billiard table as in claim 1 further including a hard coating on the upper flexible film.

8. A billiard table as in claim 1 wherein the glass has a thickness of from 12 to 18 millimetres.

9. A billiard table as in claim 1 wherein the flexible film has a thickness of from 0.1 to 0.5 millimetres.

10. A billiard table as in claim 1 wherein the liquid or gel layer has thickness of from 0.25 to 1 millimetre.

11. A billiard table as claimed in claim 2 wherein the flexible film below the transparent liquid or gel layer on the playing surface comprises a sound and shock absorbing layer.

12. A billiard table as claimed in claim 11 wherein the sound and shock absorbing layer comprises a material selected from the group comprising polyethylene, polypropylene, plasticised PVC, polyester , polyurethane, a silicone rubber film or a polytetrafluoroethylene film.

13. A billiard table as claimed in claim 11 wherein the sound and shock absorbing layer has a thickness of from 0.5 mm to 3 mm.

14. A billiard table as claimed in claim 2 further including a sound and shock absorbing layer below the lower flexible film.

15. A billiard table as claimed in claim 14 wherein the sound and shock absorbing layer comprises a material selected from the group comprising polyethylene, polypropylene, plasticised PVC, polyester , polyurethane, a silicone rubber or polytetrafluoroethylene.

16. A billiard table as claimed in claim 14 wherein the sound and shock absorbing layer has a thickness of from 0.5 mm to 3 mm.

17. A billiard table as claimed in claim 3 wherein the envelope is sealed around its edges by a heat seal.

18. A billiard table as claimed in claim 3 wherein the envelope is sealed around its edges by an adhesive.

* * * * *